US008961838B2

(12) United States Patent
Hagquist et al.

(10) Patent No.: US 8,961,838 B2
(45) Date of Patent: Feb. 24, 2015

(54) NON-AQUEOUS FIRE SUPPRESSING LIQUID CONCENTRATE

(75) Inventors: James Alroy E. Hagquist, St. Paul, MN (US); Robert M. Hume, III, Woodbury, MN (US); Ashley Saar, legal representative, Woodbury, MN (US); Terrance L. Lund, Woodbury, MN (US); Roderick I. Lund, Woodbury, MN (US)

(73) Assignee: Earthclean Corporation, South St. Paul, MN (US)

( * ) Notice: Subject to any disclaimer, the term of this patent is extended or adjusted under 35 U.S.C. 154(b) by 245 days.

(21) Appl. No.: 13/639,110

(22) PCT Filed: Apr. 5, 2011

(86) PCT No.: PCT/US2011/031223

§ 371 (c)(1),
(2), (4) Date: Mar. 4, 2013

(87) PCT Pub. No.: WO2011/127037

PCT Pub. Date: Oct. 13, 2011

(65) Prior Publication Data

US 2013/0269957 A1 Oct. 17, 2013

Related U.S. Application Data

(60) Provisional application No. 61/320,870, filed on Apr. 5, 2010.

(51) Int. Cl.

| | |
|---|---|
| ***C09K 21/14*** | (2006.01) |
| ***A62D 1/02*** | (2006.01) |
| ***A62C 3/02*** | (2006.01) |
| ***A62C 2/00*** | (2006.01) |
| ***A62D 1/00*** | (2006.01) |

(52) U.S. Cl.

CPC ..... *A62D 1/0042* (2013.01); *A62D 1/00* (2013.01); *A62D 1/0028* (2013.01); *A62D 1/005* (2013.01); *A62D 1/0064* (2013.01); *A62C 2/00* (2013.01)

USPC ..... 252/606; 252/2; 252/3; 252/8.05; 252/602; 252/603; 252/607; 252/610; 252/611; 169/44; 169/45; 169/46

(58) Field of Classification Search

USPC ..... 252/2, 3, 8.05, 601, 603, 606, 607, 610, 252/611; 169/44, 45, 46

See application file for complete search history.

(56) References Cited

U.S. PATENT DOCUMENTS

| | | | |
|---|---|---|---|
| 1,030,909 | A | 7/1912 | Mesturino |
| 1,339,488 | A | 5/1920 | Weiss |
| 1,813,367 | A | 7/1931 | Thompson |
| 2,875,044 | A | 2/1959 | Dunn |
| 3,080,316 | A | 3/1963 | Petertyl |
| 3,196,108 | A | 7/1965 | Nelson |
| 3,284,216 | A | 11/1966 | Kaplan |
| 3,464,921 | A | 9/1969 | Erler |
| 3,537,873 | A | 11/1970 | Degginger |
| 3,719,515 | A | 3/1973 | Degginger |
| 3,969,291 | A | 7/1976 | Fukuba |
| 4,065,417 | A | 12/1977 | Wong |
| 4,192,900 | A | 3/1980 | Cheng |
| 4,216,242 | A | 8/1980 | Braverman |
| 4,384,988 | A | 5/1983 | Schoenholz |
| 4,499,214 | A | 2/1985 | Sortwell |
| 4,820,380 | A | 4/1989 | O'Callaghan |
| 4,978,460 | A | 12/1990 | von Blucher |
| 5,190,110 | A | 3/1993 | von Blucher |
| 5,663,122 | A | 9/1997 | Mueller |
| 5,849,210 | A | 12/1998 | Pascente |
| 5,989,446 | A | 11/1999 | Hicks |
| 6,209,655 | B1 | 4/2001 | Valkanas |
| 6,245,252 | B1 | 6/2001 | Hicks |
| 6,386,293 | B1 | 5/2002 | Bartlett |
| 6,685,978 | B1 | 2/2004 | Hauksson |
| 6,786,286 | B1 | 9/2004 | Bartlett |
| 6,989,113 | B1 | 1/2006 | Mabey |
| 7,033,526 | B2 | 4/2006 | Figiel |
| 7,163,642 | B2 | 1/2007 | Hagquist |
| 7,189,337 | B2 | 3/2007 | Sortwell |
| 7,476,346 | B2 | 1/2009 | Hagquist |
| 7,608,208 | B2 | 10/2009 | Houben |
| 7,670,513 | B2 | 3/2010 | Erdner |

(Continued)

FOREIGN PATENT DOCUMENTS

| | | |
|---|---|---|
| GB | 760 510 | 10/1956 |
| WO | WO 2006/042064 | 4/2006 |
| WO | WO 2006/052245 | 5/2006 |

OTHER PUBLICATIONS

Biswas et al., Complexation and Blending Starch, Poly(acrylic acid), and poly(N-vinyl pyrrolidone), *ScienceDirect,* Carbohydrate Polymers 65 (2006) 397-403.

(Continued)

*Primary Examiner* — Joseph D Anthony

(74) *Attorney, Agent, or Firm* — Mueting, Raasch & Gebhardt, P.A.

(57) ABSTRACT

A fire suppression non-aqueous liquid concentrate includes starch, a pseudo-plastic, high yield, suspending agent, a $C_{10-18}$ paraffin or a $C_{10-18}$ olefin, a non-ionic surfactant, and an alcohol amine neutralizer. The non-aqueous liquid concentrate forms a dilute dispersion when added to water. The dilute dispersion clings to a surface, and forms an intumescent char coating upon fire contact.

17 Claims, No Drawings

(56) References Cited

U.S. PATENT DOCUMENTS

| | | | | |
|---|---|---|---|---|
| 8,192,653 | B2 * | 6/2012 | Hagquist et al. | 252/606 |
| 8,408,323 | B2 * | 4/2013 | Hagquist et al. | 169/45 |
| 8,734,689 | B2 * | 5/2014 | Hagquist et al. | 252/606 |
| 2002/0019318 | A1 | 2/2002 | Harris | |
| 2004/0110870 | A1 | 6/2004 | Liu | |
| 2004/0197572 | A1 | 10/2004 | Bell | |
| 2004/0208709 | A1 | 10/2004 | Marsden | |
| 2005/0045849 | A1 | 3/2005 | Sortwell | |
| 2005/0217537 | A1 * | 10/2005 | Knipe | 106/493 |
| 2006/0076531 | A1 | 4/2006 | Hagguist | |
| 2006/0157668 | A1 | 7/2006 | Erdner | |
| 2007/0289752 | A1 | 12/2007 | Beck | |
| 2008/0185160 | A1 | 8/2008 | Diener | |
| 2008/0185553 | A1 | 8/2008 | Ziemer | |
| 2008/0196908 | A1 * | 8/2008 | Schaefer | 169/46 |
| 2008/0277633 | A1 | 11/2008 | Leite | |
| 2009/0008103 | A1 | 1/2009 | Cordani | |
| 2009/0056957 | A1 | 3/2009 | Cordani | |
| 2009/0069496 | A1 | 3/2009 | Sortwell | |
| 2009/0095494 | A1 | 4/2009 | Cordani | |
| 2009/0146097 | A1 | 6/2009 | Lanciaux | |
| 2009/0151963 | A1 | 6/2009 | Sortwell | |
| 2009/0212251 | A1 | 8/2009 | Taylor | |
| 2010/0059237 | A1 | 3/2010 | Cordani | |
| 2013/0214193 | A1 * | 8/2013 | Hagquist et al. | 252/2 |
| 2013/0255972 | A1 * | 10/2013 | Hagquist et al. | 169/46 |
| 2013/0269957 | A1 * | 10/2013 | Hagquist et al. | 169/46 |

OTHER PUBLICATIONS

Barnes, Howard A.,Trixotrophy—a review, *J. Non-Newtonian Fluid Mech.,* 70 (1997) 1-33.

PCT Search Report and Written Opinion dated May 4, 2011.

Carbopol® EZ-3 Polymer, A Vertsatile, High Efficiency, Self-Wetting Rheology Modifier for Household and I&I Applications, TDS-735, Edition, Dec. 29, 2009, Lubrizol.

PCT/EP2011/031223 Search Report and Written Opinion dated Sep. 8, 2011.

* cited by examiner

NON-AQUEOUS FIRE SUPPRESSING LIQUID CONCENTRATE

This application is a U.S. National Stage Application of International Application No. PCT/US2011/031223, filed Apr. 5, 2011, which was published in English on Oct. 13, 2011 as International Patent Publication WO 2011/127037 A1, which application is hereby incorporated by reference in its entirety, and which claims the benefit under 35 U.S.C. 119(e) of U.S. Provisional Application No. 61/320,870, filed Apr. 5, 2010.

BACKGROUND

Fire is a continuing danger to life and property worldwide. In rural areas forest, brush, and grassland fires cause immense damage each year. This destruction is not only in terms of the dollar value of timber, wildlife and livestock, but the catastrophic effects on erosion, watershed equilibrium and related problems to the natural environment. In urban areas fire, and the damage from large quantities of water used to extinguish a fire, are responsible for the destruction of buildings, with the loss of billions of dollars annually. Most importantly, fire is a major danger to human life.

Over the years man has found numerous methods for combating fires. The use of water, chemicals and other extinguishing materials are well documented. Water treated with a wetting agent has been proven to be more effective on a Class A fire where good water penetration is needed to reach and extinguish the seat of the fire. Currently, there have been efforts in the area of pretreatment with chemical retardants or suppressants. A number of these pretreatments have been developed and used for fighting rural forest fires. For example, antimony oxide and its complexes, borates, carbonates, bicarbonates, ammonium phosphate, ammonium sulfates, and other salts capable of being hydrated, have been demonstrated to have useful properties as firefighting chemicals. However, although the fire inhibiting properties of the borates, carbonates and bicarbonates have been established, the use of these materials for vegetation fires has been limited because of their tendency to inhibit plant growth when used in large quantities.

Another method of fighting fires is the pretreatment of flame-retardant materials on combustible surfaces that lead to the creation of intumescent coating materials. Intumescent materials expand with heat, similar to a vermiculite which expands when exposed to steam. The expanded layer then protects the original surface from heat and flame. The problem is that an expanded intumescent is also very fragile. This problem was soon realized, and the intumescent needed a protective hard outer coating. This lead to methods using carbonaceous materials to form a char instead of the materials being consumed by the fire.

In addition to all these problems, the most difficult problem to overcome for chemical retardant formulations is that they are relatively expensive, compared to water. Also of concern is the environmental impact of absorbent particles presently used in various gel formulations. The absorbent particles pose an environmental risk once used to fight a fire, particularly when used on a large scale, such as a forest fire. The cost factor also comes into conflict with applying them in large quantities, as is often required. In combating or preventing forest, brush and grass range fires, a considerable amount of effort has been spent in the search for low cost or waste materials that are both available in quantity and inexpensive.

BRIEF SUMMARY

The present disclosure relates to a non-aqueous fire suppressing liquid concentrate. In particular the present disclosure relates to a non-aqueous fire suppressing liquid concentrate that when added to water forms a dilute dispersion. The dilute dispersion can cling to a surface and suppress or extinguish a fire.

In one illustrative embodiment, a fire suppression non-aqueous liquid concentrate includes starch, a pseudo-plastic, high yield, suspending agent, a $C_{10-18}$ paraffin or a $C_{10-18}$ olefin, a non-ionic surfactant, and an alcohol amine neutralizer. The non-aqueous liquid concentrate forms a dilute dispersion when added to water. The dilute dispersion has a pH in the range of 5.0 to 8.0, and the dilute dispersion clings to a surface, and forms an intumescent char coating upon fire contact.

In another illustrative embodiment, a method of forming a fire suppression non-aqueous liquid concentrate includes combining a $C_{10-18}$ paraffin or a $C_{10-18}$ olefin with a non-ionic surfactant and an alcohol amine neutralizer to form a first liquid composition. Then the method includes combining a pseudo-plastic, high yield, suspending agent to the first liquid composition to form a second liquid composition. Then combining a smectite clay to the second liquid composition to form a third liquid composition, and combining starch to the third liquid composition to form a fire suppression non-aqueous liquid concentrate.

In a further illustrative embodiment, a method includes diluting the non-aqueous liquid concentrate with water to form a fire suppression dispersion having from 0.1 to 10 wt % non-aqueous liquid concentrate. The fire suppression dispersion clings to a surface and forms an intumescent char coating upon fire contact.

These and various other features and advantages will be apparent from a reading of the following detailed description.

DETAILED DESCRIPTION

In the following description, it is to be understood that other embodiments are contemplated and may be made without departing from the scope or spirit of the present disclosure. The following detailed description, therefore, is not to be taken in a limiting sense. U.S. Provisional Application No. 61/320,870 filed Apr. 5, 2010 is herein incorporated by reference in its entirety.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

The present disclosure relates to non-aqueous fire suppressing liquid concentrates. In particular the present disclosure relates to non-aqueous fire suppressing liquid concentrates that when added to water forms a dilute dispersion. The dilute dispersion can cling to a surface and form an intumescent char coating upon fire contact. The non-aqueous fire suppressing liquid concentrate includes starch, a pseudo-plastic, high yield, suspending agent, a $C_{10-18}$ paraffin or a $C_{10-18}$ olefin, a non-ionic surfactant, and an alcohol amine neutralizer. The present disclosure also relates to a method of making the non-aqueous fire suppressing liquid concentrates. The components are combined as described herein to obtain a stable non-aqueous fire suppressing liquid concentrate. The present disclosure also relates to a method of using the non-aqueous fire suppressing liquid concentrates. The non-aqueous fire suppressing liquid concentrates can be diluted with water and directed toward a surface to suppress or extinguish a fire. The non-aqueous fire suppressing liquid concentrates can be diluted (e.g., dispersed in water) on or in a fire fighting vehicle or within fire fighting equipment. While the present disclosure is not so limited, an appreciation of various aspects of the disclosure will be gained through a discussion of the examples provided below.

The disclosed non-aqueous fire suppressing liquid concentrates can be augmentations to water and used to extinguish fires, for example. The non-aqueous fire suppressing liquid concentrates can be diluted with water by any suitable method to form the fire suppressing dispersion. In many embodiments, the non-aqueous fire suppressing liquid concentrate can be directed into water by any suitable method. For example the non-aqueous fire suppressing liquid concentrates can be added to a water reservoir or injected or educted directly into a liquid stream that may be directed to a substrate for fire suppression or fire retarding.

The non-aqueous liquid concentrates use starch, a pseudo-plastic, high yield, suspending agent, a $C_{10-18}$ paraffin or a $C_{10-18}$ olefin, a non-ionic surfactant, and an alcohol amine neutralizer, added to water to produce a stable, augmentation to water (i.e., fire suppressing dispersion). In many embodiments, when diluted or dispersed into water or injected into a stream of water, the fire suppressing liquid concentrate can make up from 0.05 to 10 wt % or from 0.1 to 5 wt % of the fire suppressing dispersion.

The fire suppressing dispersion is easily pumped or sprayed by typical high pressure pumping equipment or by low-pressure individual back tanks. The fire suppressing dispersion has a "high yield value," meaning it has an initial resistance to flow under stress but then is shear thinning, and when used, exhibits "vertical cling," meaning it has the ability at rest, to return to a pseudo-plastic or thixotropic gel. The fire suppressing dispersion does not readily separate or settle and can be easily sprayed and thickens when it contacts a wall or ceiling surface. This gives the firefighter, for example, the ability, unlike water alone, to build thickness and hold the fire suppressing dispersion on vertical or overhead surfaces. While not wishing to be bound to any particular theory, it is believed that the fire suppressing dispersion's mass and the vertical cling both act as a heat sink capable of clinging to vertical and overhead surfaces. This clinging to the surfaces causes the overall temperature of the surfaces to generally remain at or below the boiling point of water. The heat sink effect does not allow the temperature of the surface coated with the fire suppressing dispersion of the composition to exceed 100 degree centigrade until the water in the composition has been evaporated.

In many embodiments the non-aqueous fire suppressing liquid concentrate includes starch, a pseudo-plastic, high yield, suspending agent, a $C_{10-18}$ paraffin or a $C_{10-18}$ olefin, a non-ionic surfactant, and an alcohol amine neutralizer and optionally a smectite clay. These materials can be mixed or blended utilizing a mixer to obtain a homogenous and stable non-aqueous fire suppressing liquid concentrate composition. It has been found that these non-aqueous fire suppressing liquid concentrate compositions quickly form a stable gels, suspensions or dispersions when combined with water. In many embodiments, the diluted fire suppressing gel, dispersion or suspension has a pH in the range of 5.0 to 8.0 and the fire suppressing gel, dispersion or suspension clings to a surface positioned at nearly any orientation, and forms an exterior intumescent char coating upon fire contact, while retaining an interior aqueous gel composition.

In many embodiments the non-aqueous fire suppressing liquid concentrate includes 30-40 wt % pseudoplastic, high yield, suspending agent, 0.1-20 wt % starch, 30-50 wt % $C_{10-18}$ paraffin or a $C_{10-18}$ olefin, 0.5-5 wt % non-ionic surfactant, 5-10 wt % alcohol amine, and 0.1 to 5 wt % smectite clay. The non-aqueous fire suppressing liquid concentrate is substantially free of water. In many embodiments the non-aqueous fire suppressing liquid concentrate includes less than 5 wt % water, or less than 3 wt % water, or less than 2 wt % water, or less than 1 wt % water. Maintaining a low water content has been found to be improve the stability and usefulness of the non-aqueous fire suppressing liquid concentrate.

There are many types of pseudo-plastic high yield suspending agents or rheology modifiers that can be used successfully in the inventive composition. One major group of such suspending agents are known by their trade designation CARBOPOL™ (generally high molecular weigh homo- and copolymers of acrylic acid cross linked with a polyalkenyl polyether). CARBOPOL™ are particularly effective pseudo-plastic high yield suspending agents. One particularly useful material is CARBOPOL™ EZ-3, a hydrophobically modified cross-linked polyacrylate powder. The polymer is self-wetting and can require low agitation for dispersion. The convenience of low agitation is very evident in the very short wetting out time needed, when making a concentrate. CARBOPOL™ EZ-3 is commercially available from Noveon, Inc., Cleveland, Ohio 44141. These materials have a shear thinning rheology so they can be pumped or sprayed onto a surface without the loss of cling. Other suitable pseudo-plastic, high yield, suspending agents may include modified guar and xantham gums, casein, alginates, modified cellulose, including methyl cellulose, hydroxyethyl cellulose, hydroxypropyl cellulose and carbomethyl cellulose, gum tragacanth, synthetic polymers such as polyvinyl alcohol, polyvinyl acetate, polyethylene oxide, polypropylene oxide and polyvinylpyrolidone, to name a few used individually or in combination.

The non-aqueous fire suppressing liquid concentrate and resulting fire suppressing dispersion can have a high yield value with a "shear thinning capacity" which means, the non-aqueous fire suppressing liquid concentrate or fire suppressing dispersion becomes thin when pumped and thixotropic or pseudoplastic or sag resistant, at rest. Thus, after being pumped and sprayed, the non-aqueous fire suppressing liquid concentrate or fire suppressing dispersion is capable of clinging to a vertical, inclined, or overhead surface.

Any starch can be used in the non-aqueous fire suppressing liquid concentrate. Examples of starches and their modifications, include corn, wheat, potato, tapioca, barley, arrowroot, rice or any combination of starches. It is believed that dry starch contains about 12% water and has a particle size in a range from 1 to 50 micrometers. When soaked in water, the starch associates and holds up to 18% water and the particle size increases to 40 micrometers. As the fire suppressing dispersion is heated (e.g., by a fire), the starch forms a gel or association with the surrounding water starting around 70 degrees centigrade. Thus, when the fire suppressing dispersion is heated, either from the substrate or the air side, the starch absorbs more water at the interface and becomes thicker. Then it is believed that on the substrate side, the fire suppressing dispersion first rides on its own vapor and, as it cools, forms its own film on the substrate surface. On the air side, where evaporation largely occurs, the fire suppressing dispersion first thickens and then crusts over and eventually is converted to a carbonized char. The char formed is a hard, intumescent coating, which slows the evaporation of water from the fire suppressing dispersion. In essence, the fire suppressing dispersion's own film and char act as a vessel to contain the soft-gelled composition, which now acts as a heat sink to cool the backside of the intumescent char. This synergism between the intumescent hard coating and the fire suppressing dispersion's aqueous gel helps optimize the amount of water. The char/gel coating further reduces the available combustible material to the fire, and also reduces the smoke emission.

Hydrophobic agglomerating material can be added to the non-aqueous fire suppressing liquid concentrate. It has been found that the hydrophobic agglomerating material improves the material properties as compared to compositions that do not include the composition. While not wishing to be bound to any particular theory, it is believed that the hydrophobic agglomerating material improves the speed at which the aqueous gel or aqueous suspension is formed. In many fire suppression applications, quick formation of the aqueous gel or aqueous suspension is important.

In some embodiments the hydrophobic agglomerating material includes liquid paraffins or olefins. Paraffin is the common name for alkane hydrocarbons with the general formula $C_nH_{2n+2}$. Liquid paraffin generally have less than 20 carbon atoms. In many embodiments the paraffin has from 10 to 18 carbon atoms or 10 to 14 carbon atoms and is linear, or has from 14 to 16 carbon atoms and is a linear alkane. Olefin is the common name for alkene hydrocarbons with the general formula $C_nH_{2n}$ where the hydrocarbon is not saturated. In many embodiments the olefin has from 10 to 18 carbon atoms or 10 to 14 carbon atoms and is linear, or has from 14 to 16 carbon atoms and is a linear alpha olefin.

Commercially available paraffins and olefins include BIO-BASE™ 100LF (linear internal olefin with a carbon chain length between C15 and C18), BIO-BASE™ 300 (linear paraffin with a carbon chain length between C11 and C14), BIO-BASE™ 200 (linear alpha olefin with a carbon chain length between C16 and C18), BIO-BASE™ 220 (linear alpha olefin with a carbon chain length between C14 and C16), BIO-BASE™ 250 (linear alpha olefin with a carbon chain length between C14 and C18), BIO-BASE™ 360 (blend of iso-paraffins and linear paraffins with a carbon chain length between C15 and C16), all are available from Shrieve Chemical Products Company (Woodlands, Tex.). It has been found that the presence of the hydrophobic agglomerating material improves the performance of the non-aqueous fire suppressing liquid concentrate.

The non-aqueous fire suppressing liquid concentrate can include a neutralizer (e.g., a basic neutralizing material.) In many embodiments the basic neutralizing material is any material capable of increasing pH when added to an aqueous material (e.g., forming the aqueous suspension). In many embodiments the basic material includes other neutralizers. In some embodiments the basic neutralizing material includes an alcohol amine neutralizer such as, for example, an amino-methyl-propanol (e.g., 2-amino-2-methly-1-propanol). One commercially available alcohol amine is AMP-100™ and is available from Angus Chemical Company, for example.

The non-aqueous fire suppressing liquid concentrate can include a surfactant. In many embodiments the surfactant is a non-ionic surfactant. In some embodiments the non-ionic surfactant includes an alkoxylated alcohol non-ionic surfactant. One commercially available alkoxylated alcohol non-ionic surfactant is DeIonic™ LF-EP-61 and is available from DeForest Enterprises Inc., (Boca Raton, Fla.) for example.

The non-aqueous fire suppressing liquid concentrate can include a smectite clay. The smectite clay can be included in any useful amount and can act as a suspending agent. Commercially available smectite clay is available under the trade designations Bentone™ SD1 and Bentone™ SD3 and is available from Elementis Specialities Inc., (Highstown, N.J.) for example.

It has been found that the stability of the non-aqueous fire suppressing liquid concentrate can depend upon the order of addition of the components of the non-aqueous fire suppressing liquid concentrate. A stable non-aqueous fire suppressing liquid concentrate has been formed when combined in the following manner. First, combining a $C_{10-18}$ paraffin or a $C_{10-18}$ olefin with a non-ionic surfactant and an alcohol amine neutralizer to form a first liquid composition; then combining a pseudo-plastic, high yield, suspending agent to the first liquid composition to form a second liquid composition; then combining a smectite clay to the second liquid composition to form a third liquid composition; and finally combining starch to the third liquid composition to form a fire suppression non-aqueous liquid concentrate. It is believed that the clay and starch are added last since they contain the most water and minimizing the amount of water in the non-aqueous fire suppressing liquid concentrate has been found to unexpectedly enhance stability of the non-aqueous fire suppressing liquid concentrate.

One exemplary non-aqueous fire suppressing liquid concentrate is formed by combining a $C_{10-18}$ paraffin or a $C_{10-18}$ olefin (e.g., BIO-BASE™ 200) with a non-ionic surfactant (e.g., DeIonic™ LF-EP-61) and an alcohol amine neutralizer (AMP-100) to form a first liquid composition. This first liquid composition was mixed to form a homogenous first liquid composition. Then combining a pseudo-plastic, high yield, suspending agent (e.g., CARBOPOL™ EZ-3) to the first liquid composition to form a second liquid composition. This second liquid composition was mixed to form a homogenous second liquid composition. Then combining a smectite clay (e.g., Bentone SD-3) to the second liquid composition to form a third liquid composition. This third liquid composition was mixed to form a homogenous third liquid composition. Finally combining starch (e.g., corn starch) to the third liquid composition to form a fire suppression non-aqueous liquid concentrate and mixed until the liquid material is homogenous. One exemplary fire suppressing liquid concentrate was formed by combining 40 wt % BIO-BASE™ 200, 1 wt % DeIonic™ LF-EP-61, 7 wt % AMP-100, 36 wt % CARBOPOL™ EZ-3, 1.5 wt % Bentone SD-3, and 14.5 wt % corn starch. Wt % is based on the total weight of the non-aqueous fire suppressing liquid concentrate.

The resulting non-aqueous fire suppressing liquid concentrate can be packaged (in an air-tight container) for later use such as, combining it with an amount of water and directing the diluted product onto a surface to suppress or retard fire, as described above. The non-aqueous fire suppressing liquid concentrate can be diluted with water to form a fire suppression dispersion having from 0.05 to 10 wt % non-aqueous fire suppressing liquid concentrate in water. The fire suppression dispersion clings to a surface and forms an intumescent char coating upon fire contact. The fire suppression dispersion can then be directed toward a surface to suppress fire. The non-aqueous fire suppressing liquid concentrate can be diluted on a firefighting vehicle or within firefighting equipment.

In some embodiments the non-aqueous fire suppressing liquid concentrate includes 33-38 wt % pseudo-plastic, high yield, suspending agent (e.g., acrylic acid copolymer cross linked with a polyalkenyl polyether), 10-15 wt % starch, 35-45 wt % $C_{14-16}$ paraffin or a $C_{14-16}$ olefin, 0.5-2 wt % non-ionic surfactant (e.g., alkoxylated alcohol non-ionic surfactant), 5-10 wt % alcohol amine (e.g., 2-amino-2-methyl-1-propanol), and 0.1-2.5 wt % smectite clay. The non-aqueous fire suppressing liquid concentrate is substantially free of water. In many embodiments the non-aqueous fire suppressing liquid concentrate includes less than 5 wt % water, or less than 3 wt % water, or less than 2 wt % water, or less than 1 wt % water. Maintaining a low water content has been found to be improve the stability and usefulness of the non-aqueous fire suppressing liquid concentrate.

Thus, embodiments of the NON-AQUEOUS FIRE SUPPRESSING LIQUID CONCENTRATE are disclosed. The implementations described above and other implementations are within the scope of the following claims. One skilled in the art will appreciate that the present disclosure can be practiced with embodiments other than those disclosed. The disclosed embodiments are presented for purposes of illustration and not limitation, and the present invention is limited only by the claims that follow.

What is claimed is:

1. A fire suppression non-aqueous liquid concentrate comprising;

0.1-20 wt % starch;

30-40 wt % of a pseudo-plastic, high yield, suspending agent;

30-50 wt % of a $C_{10-18}$ paraffin or a $C_{10-18}$ olefin;

0.5-5 wt % of a non-ionic surfactant;

5-10 wt % of an alcohol amine neutralizer; and wherein the non-aqueous liquid concentrate forms a fire suppressing dispersion when added to water; whereby the fire suppressing dispersion clings to a surface, and forms an intumescent char coating upon fire contact.

2. The liquid concentrate according to claim 1 wherein the paraffin comprises a $C_{14}$ to $C_{16}$ linear alkane or the olefin comprises a $C_{14}$ to $C_{16}$ linear alpha olefin.

3. The liquid concentrate according to claim 1 wherein the pseudo-plastic, high yield, suspending agent comprises an acrylic acid copolymer cross linked with a polyalkenyl polyether.

4. The liquid concentrate according to claim 1 wherein the alcohol amine neutralizer comprises 2-amino-2-methly-1-propanol.

5. The liquid concentrate according to claim 1 wherein the non-ionic surfactant comprises an alkoxylated alcohol non-ionic surfactant.

6. The liquid concentrate according to claim 1 further comprising a smectite clay.

7. The liquid concentrate according to claim 1 wherein the liquid concentrate comprises less than 5 wt % water.

8. The liquid concentrate according to claim 6 wherein the smectite clay is present at a concentration of 0.1-5 wt %.

9. The liquid concentrate according to claim 1 comprising:

10-15 wt % starch;

33-38 wt % pseudo-plastic, high yield, suspending agent comprising acrylic acid copolymer cross linked with a polyalkenyl polyether;

35-45 wt % $C_{14-16}$ paraffin or $C_{14-16}$ olefin;

0.5-2 wt % non-ionic surfactant comprising alkoxylated alcohol non-ionic surfactant;

5-10 wt % alcohol amine neutralizer comprising 2-amino-2-methly-1-propanol; and 0.1-2.5 wt % smectite clay.

10. A method of forming a fire suppression non-aqueous liquid concentrate comprising:

combining a $C_{10-18}$ paraffin or a $C_{10-18}$ olefin with a non-ionic surfactant and an alcohol amine neutralizer to form a first liquid composition;

combining a pseudo-plastic, high yield, suspending agent to the first liquid composition to form a second liquid composition;

combining a smectite clay to the second liquid composition to form a third liquid composition; and combining starch to the third liquid composition to form a fire suppression non-aqueous liquid concentrate; wherein the fire suppression non-aqueous liquid concentrate comprises:

0.1-20 wt % starch;

30-40 wt % pseudo-plastic, high yield, suspending agent;

30-50 wt % $C_{10-18}$ paraffin or $C_{10-18}$ olefin;

0.5-5 wt % non-ionic surfactant;

5-10 wt % alcohol amine neutralizer; and 0.1-5 wt % smectite clay.

11. The method according to claim 10 wherein the liquid concentrate comprises less than 5 wt % water.

12. The method according to claim 10 wherein first liquid composition is mixed until a homogenous first liquid composition is formed and the second liquid composition is mixed until a homogenous second liquid composition is formed and the third liquid composition is mixed until a homogenous third liquid composition is formed and the fire suppression non-aqueous liquid concentrate is mixed until a homogenous fire suppression non-aqueous liquid concentrate is formed.

13. The method according to claim 10 wherein the fire suppression non-aqueous liquid concentrate comprises:

10-15 wt % starch;

33-38 wt % pseudo-plastic, high yield, suspending agent comprising acrylic acid copolymer cross linked with a polyalkenyl polyether;

35-45 wt % $C_{14-16}$ paraffin or $C_{14-16}$ olefin;

0.5-2 wt % non-ionic surfactant comprising alkoxylated alcohol non-ionic surfactant;

5-10 wt % alcohol amine neutralizer comprising 2-amino-2-methly-1-propanol; and 0.1-2.5 wt % smectite clay.

14. A method comprising:

diluting the non-aqueous liquid concentrate of claim 1 with water to form a fire suppression dispersion comprising from 0.05 to 10 wt % non-aqueous liquid concentrate, wherein the fire suppression dispersion clings to a surface and forms an intumescent char coating upon fire contact.

15. The method according to claim 14 further comprising directing the fire suppression dispersion onto a surface to suppress fire.

16. The method according to claim 14 wherein the diluting occurs on a fire firefighting vehicle.

17. The method according to claim 14 wherein the diluting occurs within fire firefighting equipment.

* * * * *